US005782372A

United States Patent [19]

Weiss et al.

[11] Patent Number: 5,782,372

[45] Date of Patent: *Jul. 21, 1998

[54] COLLAPSIBLE CARRYING CASE

[76] Inventors: Marla Weiss, 64-39 98th, St. Rego Park, N.Y. 11374; Eugene C. Rzucidlo, 48 Shaw Rd., Woodeliff Lake, N.J. 07675

[ * ] Notice: The term of this patent shall not extend beyond the expiration date of Pat. No. 5,579,940.

[21] Appl. No.: 753,776

[22] Filed: Dec. 2, 1996

Related U.S. Application Data

[63] Continuation-in-part of Ser. No. 569,361, Dec. 8, 1995, Pat. No. 5,579,940.

[51] Int. Cl.[6] ..... B65D 8/14

[52] U.S. Cl. ..... 220/8; 220/4.27; 132/287

[58] Field of Search ..... 220/8, 4.27, 23.83, 220/503; 132/287; 206/501

[56] References Cited

U.S. PATENT DOCUMENTS 5,579,940 12/1996 Weiss et al. ..... 220/8

*Primary Examiner*—Steven M. Pollard

*Attorney, Agent, or Firm*—Eugene C. Rzucidlo

[57] ABSTRACT

A carrying case which can be opened or collapsed is disclosed. The carrying case has at least a first nestable module and a second nestable module. The first module has a bottom portion which has an inward projection. A side portion of the first module has a compartment which can be withdrawn from the first module. A second module has a top portion which has an outward projection and a side portion of the second module has a compartment which can be withdrawn from the second module, wherein the outward and inward projections of the first and second modules cooperate as a stop means for controlling the opening of the carrying case. The first and second modules are nestable within one another and are adapted to slidably collapse into one another and slidably open into a position to provide access to the compartments.

15 Claims, 4 Drawing Sheets

COLLAPSIBLE CARRYING CASE

This is a continuation-in-part application of U.S. Ser. No. 08/569,361 filed Dec. 8, 1995, which will issue on Dec. 3, 1996 as U.S. Pat. No. 5,579,940.

FIELD OF THE INVENTION

The present invention relates generally to devices which are compact but which can contain a variety of items therein including cosmetics, jewelry, tools or medicines.

BACKGROUND OF THE INVENTION

Cosmetic items are normally packaged in individual carrying cases. Hence, items such as lip gloss, eye make up, facial make up, powder and blush are individually packaged. The individual packages may contain various hues of any one item but, normally, most carrying cases do not contain different cosmetic items in one package.

In the modern world, women frequently utilize a variety of cosmetic items. A single application of a cosmetic item during any particular day may not be sufficient to maintain the full impact sought to be achieved from the cosmetic item. It is therefor necessary that women reapply cosmetic items during the course of a day or evening. Refreshing cosmetic items and make up is also required during extended or overnight trips.

It is inconvenient for women to carry a cosmetic case with all of the necessary cosmetic items contained therein. Furthermore, carrying a large number of individual cosmetic item packages in a purse is inconvenient and uncomfortable.

There is a need for a compact cosmetic carrying case in which an assortment of cosmetic items can be conveniently contained.

Additionally, there is a need for carrying cases which are compact and which can easily and conveniently store a variety of items.

SUMMARY OF THE INVENTION

The instant compact carrying case comprises several modules which are adapted to be collapsible and extendible. When extended the compact carrying case provides access to several drawers containing selected items. The modules of the carrying case comprise a top module and at least one further module which is nestable within the top module. If there are more than one further modules, then each of such further modules is nestable within the next succeeding further module. Each further module as well as the top module contains a drawer-like compartment which can be pulled out to gain access to a selected item or items within the draw-like compartment. In one possible embodiment of the invention, the present compact carrying case is a carrying case for cosmetic items. In this sense the draw-like compartments can each contain various cosmetic materials or accessories for applying a cosmetic item such as a brush or a puff.

The preferred compact cosmetic item carrying unit which can contain an assortment of various cosmetic items and the case is collapsible so as to occupy a minimum amount of space as compared to conventional cosmetic item carrying units. The instant compact can be made in various geometrical configurations and the invention is not limited with respect to shape. Hence, while the exemplary embodiments have a somewhat rectangular cross-section, other cross-sections such as square, circular, oval, triangular, etc. are possible. Additionally, fanciful shapes such as the shapes of animals, flowers or gem stones, for example, can be used to construct the modules and carrying case.

DETAILED DESCRIPTION OF THE PREFERRED EMBODIMENT

Figure 1:
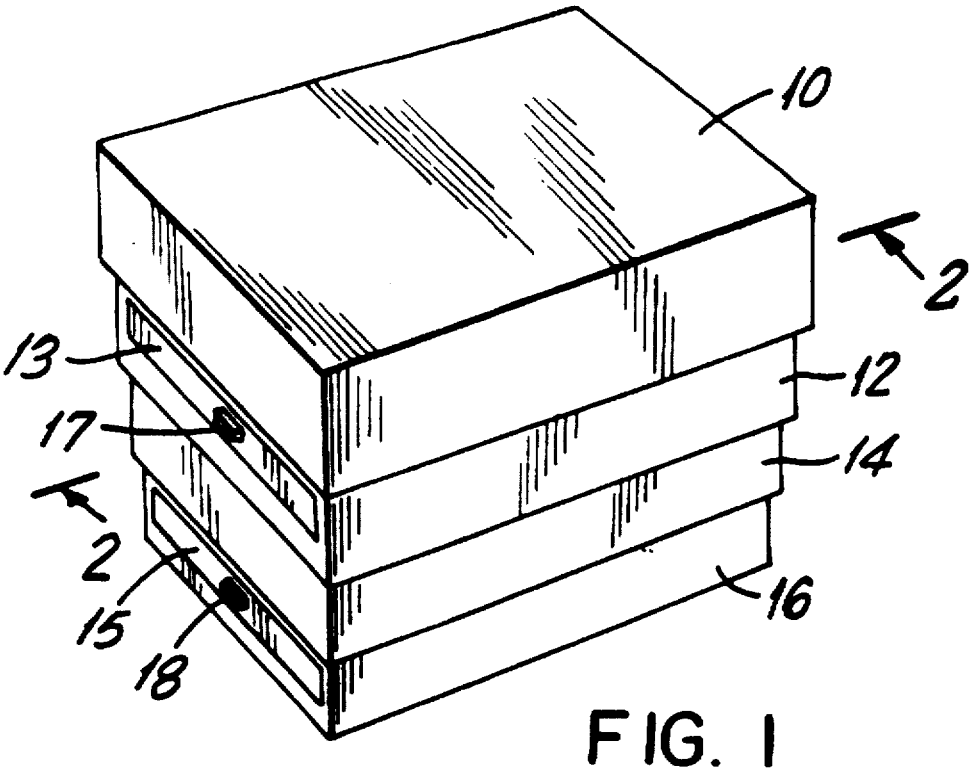
FIG. 1 is a perspective view of a compact carrying case in collapsed form.

For the purposes of promoting an understanding of the teachings of the present invention, reference will now be made to the embodiments illustrated in the drawings and specific language will be used to describe these embodiments. It will nevertheless be understood that no limitation of the scope of the invention is thereby intended, alterations and further applications of the teachings of the present invention as illustrated and described hereinabove is anticipated by those skilled in this art.

Figure 2:
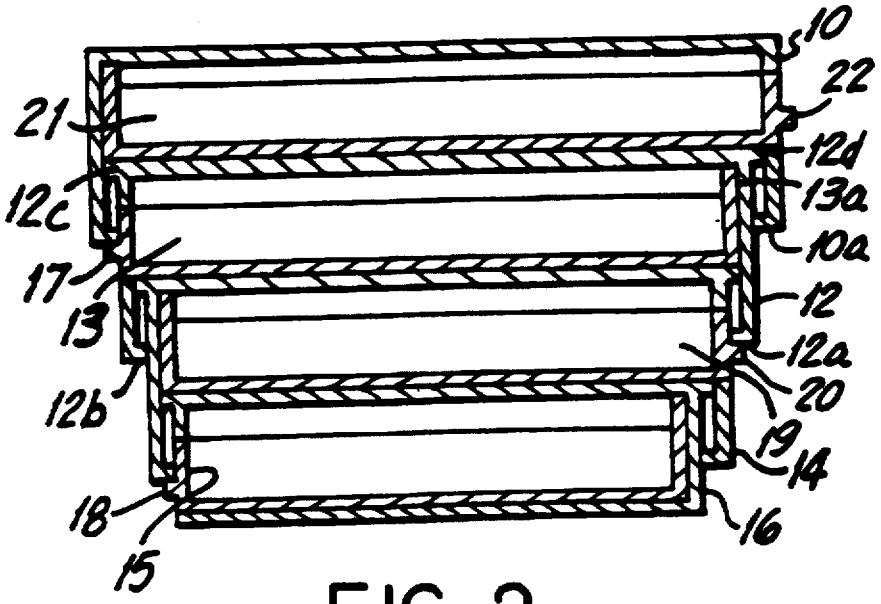
FIG. 2 is a cross-sectional view of a compact case in collapsed form.
Figure 3:
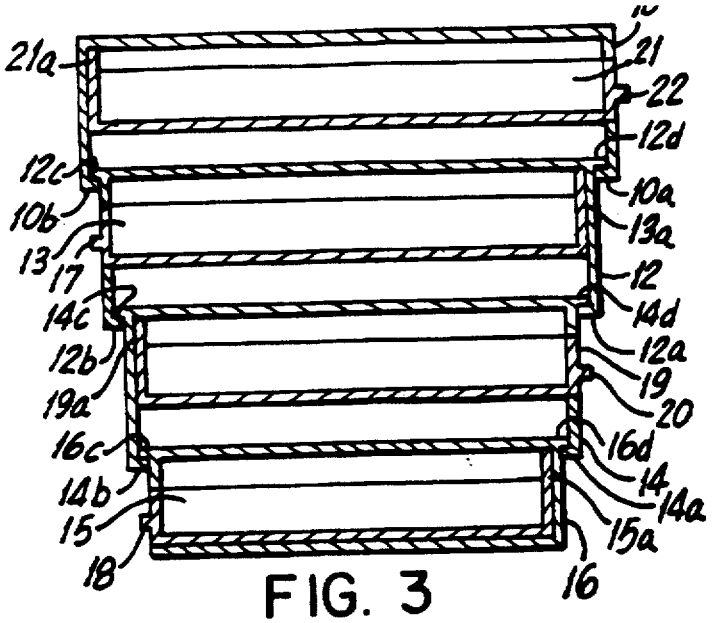
FIG. 3 is a cross-sectional view of a compact case in extended form.

Referring to FIGS. 1, 2 and 3, the present invention relates to a compact collapsible and expandable carrying case 1 for various items including, inter alia, cosmetics and cosmetic accessories and cosmetics applicators (not shown). Additionally, the carrying case can be used as a jewelry box, for office supplies, for storing medical or dental equipment, as a pill box, as a sewing box, as a lunch box, for hardware items, as an artists box or as a tool box. The carrying case 1 comprises a number of nestable modules 10, 12, 14 and 16 which nest within each other and can be collapsed to form a compact unit as shown in FIGS. 1, 2 and 3. As shown in the figures, the largest module is the top module while the lower modules are successively smaller. However, it is also within the scope of the invention to provide carrying cases in which the largest module is the bottom module and the remaining modules are successively smaller.

There are, in general, three possible types of modules which can be used to construct the present compact carrying cases. These are a top module unit 10, a bottom module unit 16, and interior module units 12, 14.

The minimum number of module units which can be used to construct an instant compact carrying case is one top modular unit 10 and one bottom modular unit 16. In order to provide proper collapsing and expanding, the top module 10 is the largest or smallest in size of the modules while the bottom module unit 16 is the smallest or largest in size. The intermediate in size relative to the top and bottom module units and are sized so as to nest within one another. When more than one intermediate module is employed, the modules are sized such the intermediate module nesting within the top module is the largest or smallest intermediate module depending on whether the top module is the largest or smallest module while the intermediate module nesting within the bottom module is the smallest or largest intermediate module depending on whether the bottom module is the largest or smallest module.

If so desired each of the modules including the top, intermediate and bottom modules can contain a drawer-like component 15, 17, 19 and 21. The drawer-like components 15, 17, 19 and 21 slide into their respective module and are adapted to hold any number of possible materials such as in a particular embodiment cosmetic items or applicators for the cosmetic items. Each of the drawers has a projection 17, 18, 20 and 22 extending from it outer surface which can be used to pull the drawer-like component out of the module. The projections 17, 18, 20 and 22 also act as stops to prevent a module above the drawer-like component to collapse down a too great a distance and, hence, the contents of the drawer-like components are protected from being damaged. The position of the projections 17, 18, 20 and 22 can be used to adjust the compactness of the instant carrying case. In effect, the level of collapsibility can be controlled by placing the projections 17, 18, 20 and 22 in a lower or higher position in the drawer. The level of collapsibility of each module can be controlled in this manner. Additionally, the case can be constructed such that the modules collapse to provide an almost flat final unit.

Figure 4:
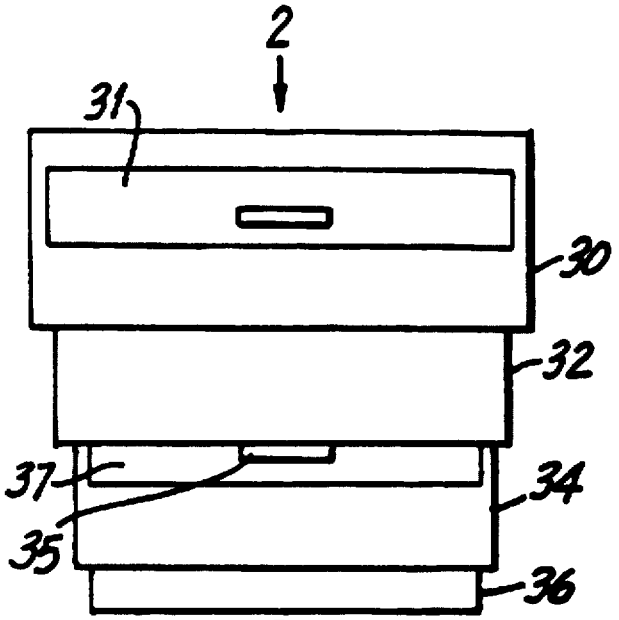
FIGS. 4 and 5 show a side view of the compact case in collapsed and extended forms, respectively.
Figure 5:
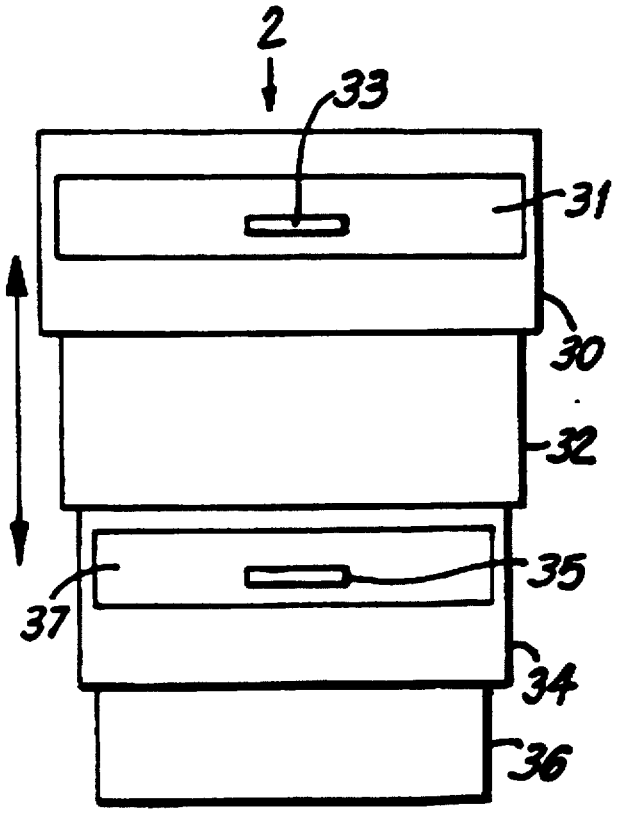

The modules have inward and/or outward projections or flanges which cooperate with projections 17, 18, 20 and 22 and with each other to facilitate proper opening and collapsing of the carrying case 1. Top module 10 has inwardly facing projection 10*a* and 10*b* on the bottom portion of top module 10. The figures do not show a top module having an outwardly facing projection on its top portion. However, it is possible to include such an outward projection if so desired. Intermediate modules have both outward projections 12*c*, 12*d*, 14*c* and 14*d* on the top portions of the intermediate modules and inward projections 12*a*, 12*b*, 14*a* and 14*b* and the bottom portions of intermediate modules 12 and 14. Bottom module 16 has outward projections 16*c*, 16*d* on the top portion thereof. As can be seen in FIG. 2, when the carrying unit is in its collapsed form, the inward projections 14*a*, 14*b*, 12*a*, 12*b*, 10*a*, 10*b* can cooperate with projections 17, 18, 20 and 22 to stop the modules from collapsing one into the other. Similarly, in FIG. 3, it can be seen that adjacent inward and outward projections of adjacent modules cooperate to stop the units from being pulled away from one another. Each of the modules may be pretensioned so that when the modules are pulled outwardly to open the carrying case 1 the modules cooperate with one another to prevent the carry case from collapsing. The pretensioning should be sufficient to maintain the carrying case in an open position but should be such that the carrying case cannot be easily closed by manual pressure. The drawer-like compartments have upward projections 21*a*, 13*a*, 19*a* and 15*a* which prevent the drawer-like compartment from being accidentally being completely pulled out of the module. 4 and 5 show a side view of a carrying case 2 in collapsed form (FIG. 4) and opened form (FIG. 5). The carrying case 2 comprised top module 30, intermediate modules 32, 34 and bottom module 36. The modules 30, 32, 34, 36 have drawer-like compartments 31, 35 with projections 33, 35 on the outside thereof to facilitate withdrawing of the drawer-like compartments from the modules. It should be understood that the modules 32 and 36 may also have drawer-like compartments which are not seen because of the side projection of these figures.

Figure 6:
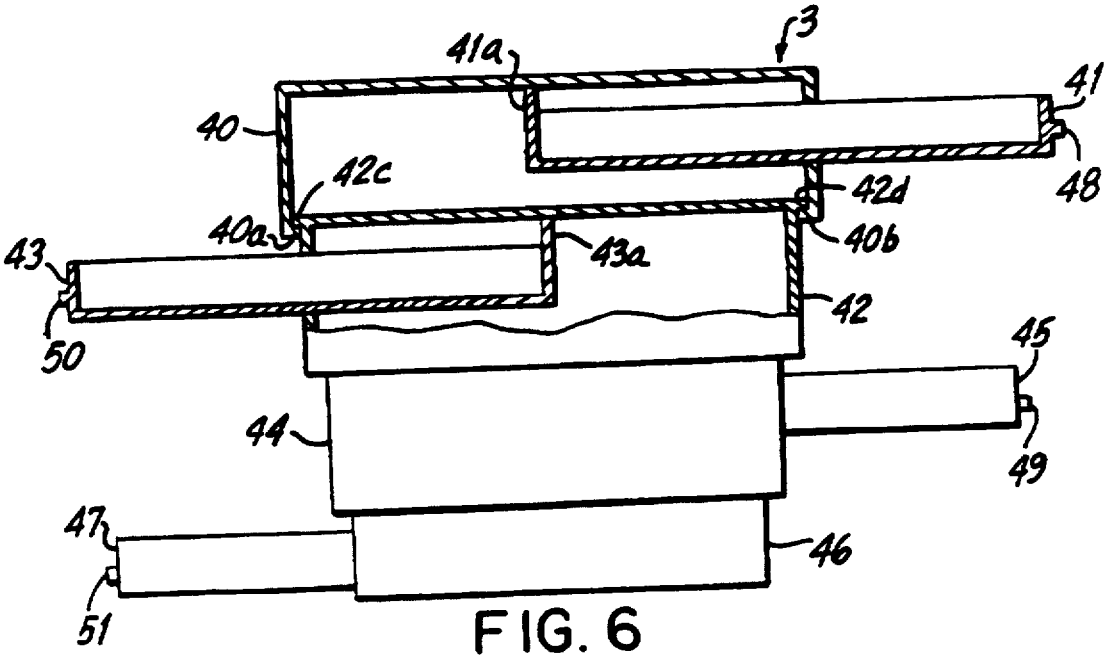
FIG. 6 shows a partial cross-sectional view of a side view of the compact case with the draw-like compartments in a pulled out position.

FIG. 6 is a partial cross-sectional of a carrying case 3 having a top module 40, intermediate modules 42, 44 and a bottom module 46. Each module has a drawer-like compartment 41, 43, 45, 47 which can be withdrawn from the module and which are adapted to contain various items including interalia, cosmetic items or cosmetic applicators (not shown). The drawer-like compartments 41, 43, 45, 47 can have outward projections or knob-like projections 48, 50, 49, 51 which can be used to pull the drawer-like compartments from the module. The cross-section portion shows the inward and outward projections on the modules which cooperate with one another or with the drawer-like compartment drawers and act as stops in the opening and closing of the carrying case 3. Top module 40 has inward projections 42*c*, 42*d*. In the cross-section one can see upward projections 41*a*, 43*a* on drawer-like compartments 41, 43 which projections prevent the drawer-like compartments from being accidentally totally pulled out of the module.

Figure 7:
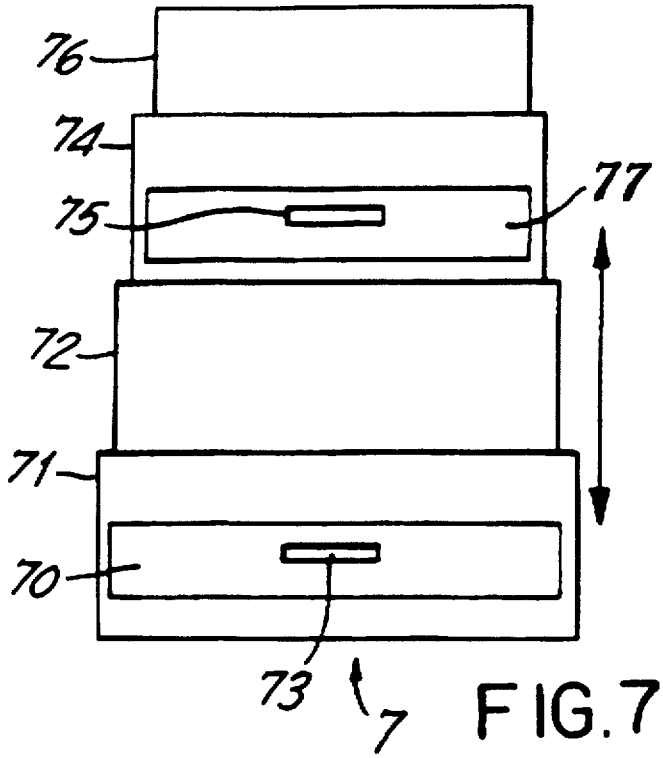
FIGS. 7 and 8 show a side view of a compact case in collapsed and extended forms in which the bottom module is the largest module.
Figure 8:
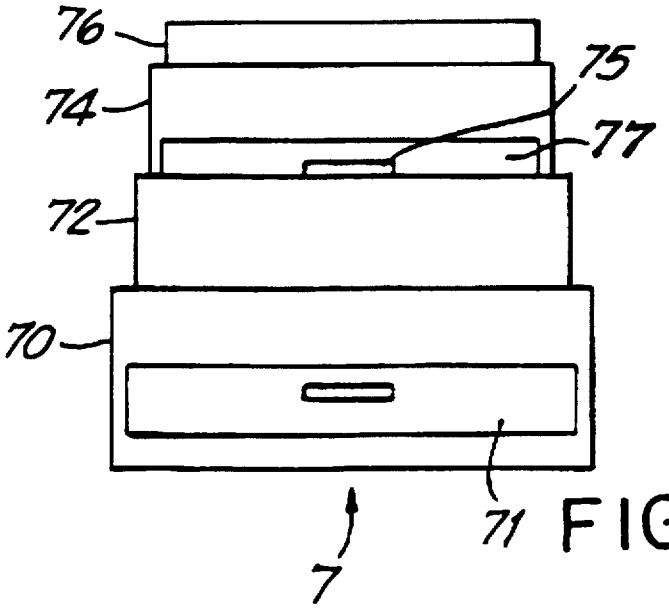

FIGS. 7 and 8 show a side view of the instant carrying case 7 in which the bottom module is the largest module while the top module is the smallest module.

The carrying case 7 shown in open form (FIG. 7) and in closed form (FIG. 8) comprises top module 70, intermediate modules 72, 74 and bottom module 76. The modules 70, 72, 74, 76 have drawer-like compartments 71, 75 with projection 73, 75 on the outside thereof to facilitate withdrawing of the drawer-like compartments from the modules. It should be understood that modules 72, 76 may also have drawer-like compartments. The positions of projections 73, 75 can be varied by lowering or raising the projections so as to control the level of collapsibility of the modules into one another.

The foregoing description has been directed to particular embodiments of the invention in accordance with the requirements of the Patent Statutes for the purposes of illustration and explanation. It will be apparent, however, to those skilled in this art that many modifications and changes will be possible without departure from the scope and spirit of the invention. It is intended that the following claims be interpreted to embrace all such modifications.

What is claimed:

1. A carrying case which can be opened or collapsed comprising at least a first nestable module and a second nestable module, said first module having a bottom portion which has an inward projection, a side portion of said first module having compartment which can be withdrawn from said first module, said second module having a top portion which has an outward projection and a side portion of said second module having a compartment which can be withdrawn from the second module, wherein the outward and inward projections of the first and second modules cooperate as a stop means for controlling the opening of the carrying case, said first and second modules being nestable within one another and being adapted to slidably collapse into one another and slidably open into a position to provide access to the compartments wherein the first module is larger than the second module.

2. The carrying case according to claim 1, wherein said compartments in said first and second modules have a means for opening and closing said compartments and wherein said means for opening and closing cooperate with inward projection to act as a means for stopping collapse of the nestable modules.

3. The carrying case according to claim 2, wherein a position of the opening and closing means is varied to control an amount of the collapsing the nestable modules.

4. The carry case according to claim 2, further comprising at least one third intermediate module, wherein the third intermediate module is adapted to be nestable with the first and second module or to be nestable with either the first or the second module and an adjacent third module, said third modules having a bottom portion with an inward projection and a top portion with an outward projection and a side portion with a compartment which can be withdrawn from the third modules, said third intermediate modules being nestable within an upper and lower adjacent module and being adapted to slidably collapse and slidably open to provide access to the compartments.

5. The carrying case according to claim 4, wherein said compartments in the at least one third intermediate module is adapted to be nestable with the first and second module or to be nestable with either the first or the second module and an adjacent third module, said third modules having a bottom portion with an inward projection and a top portion with an outward projection and a side portion with a compartment which can be withdrawn from the third modules, said third intermediate modules being nestable within an upper and lower adjacent module and being adapted to slidably collapse and slidably open to provide access to the compartments.

6. The carrying case according to claim 4, wherein the compartments have a rear wall having an upward projection which prevents the compartment from being pulled out of the module.

7. The carrying case according to claim 1, wherein the compartments have a rear wall having an upward projection which prevents the compartment from being pulled out of the module.

8. The carrying case according to claim 7, comprising the first module, the second module and two third intermediate modules.

9. A carrying case which can be opened or collapsed comprising at least a first nestable module and a second nestable module, said first module having a bottom portion which has an inward projection, a side portion of said first module having compartment which can be withdrawn from said first module, said second module having a top portion which has an outward projection and a side portion of said second module having a compartment which can be withdrawn from the second module, wherein the outward and inward projections of the first and second modules cooperate as a stop means for controlling the opening of the carrying case, said first and second modules being nestable within one another and being adapted to slidably collapse into one another and slidably open into a positions to provide access to the compartments, wherein the first module is smaller than the second module.

10. The carrying case according to claim 9, wherein said compartments in said first and second modules have a means for opening and closing said compartments and wherein said means for opening and closing cooperate with inward projection to act as a means for stopping collapse of the nestable modules.

11. The carry case according to claim 10, further comprising at least one third intermediate module, wherein the third intermediate module is adapted to be nestable with the first and second module or to be nestable with either the first or the second module and an adjacent third module, said third modules having a bottom portion with an inward projection and a top portion with an outward projection and a side portion with a compartment which can be withdrawn from the third modules, said third intermediate modules being nestable within an upper and lower adjacent module and being adapted to slidably collapse and slidably open to provide access to the compartments.

12. The carrying case according to claim 10, wherein said compartments in the at least one third intermediate module is adapted to be nestable with the first and second module or to be nestable with either the first or the second module and an adjacent third module, said third modules having a bottom portion with an inward projection and a top portion with an outward projection and a side portion with a compartment which can be withdrawn from the third modules, said third intermediate modules being nestable within an upper and lower adjacent module and being adapted to slidably collapse and slidably open to provide access to the compartments.

13. The carrying case according to claim 9, wherein the compartments have a rear wall having an upward projection which prevents the compartment from being pulled out of the module.

14. The carrying case according to claim 9, wherein the compartments have a rear wall having an upward projection which prevents the compartment from being pulled out of the module.

15. The carrying case according to claim 13, comprising the first module, the second module and two third intermediate modules.

* * * * *